United States Patent [19]

Wessels et al.

[11] 4,400,698

[45] Aug. 23, 1983

[54] SINGLE CHANNEL RADIO CONTROL SYSTEM

[75] Inventors: John A. Wessels, Monterey Park, Calif.; Feng I. Chen, Taichung Hsien, China

[73] Assignee: Entex Industries, Inc., Compton, Calif.

[21] Appl. No.: 336,198

[22] Filed: Dec. 31, 1981

[51] Int. Cl.[3] ..... G08C 19/00; A63H 30/04; H04Q 7/02

[52] U.S. Cl. ..... 340/825.72; 340/825.69; 340/696; 46/254; 46/262; 318/16; 318/581; 318/587; 180/2 R; 180/167

[58] Field of Search ..... 340/825.72, 825.69, 340/696; 46/248, 249–251, 253, 254, 262; 318/16, 581, 587; 180/167, 168, 2 R; 273/86 B, 86 R; 455/39, 66, 68, 70, 95, 352, 344, 345

[56] References Cited

U.S. PATENT DOCUMENTS

| | | | |
|---|---|---|---|
| 4,166,338 | 9/1979 | Asano | 46/254 |
| 4,224,762 | 9/1980 | McCaslin | 340/825.72 |
| 4,248,011 | 2/1981 | Shimamura | 46/254 |

OTHER PUBLICATIONS 2,039,754 A, Great Britain, Kin Leung, Aug. 20, 1980, pp. 1–4, figures 1–6.

*Primary Examiner*—Donnie Lee Crosland
*Attorney, Agent, or Firm*—Don B. Finkelstein; Timothy Tyson Thut; John E. Halamka

[57] ABSTRACT

A single channel continuous wave transmitter and receiver to produce a control signal to change the direction of the drive motor of a toy such as a model car having steerable wheels. A single electric motor provides the propulsion for the toy in one direction through the engagement of a planetary gear with a primary drive gear. The planetary gear is mounted on a rotatable ring surrounding the drive gear. When the direction of the motor is changed, the driver gear on the motor which is meshed with the planetary gear causes the planetary gear and ring to rotate until the planetary gear engages a secondary drive gear thereby changing the direction of travel of the vehicle. The rotational movement of the ring is also used as an actuator mechanism. This actuator mechanism is coupled to a cam that is in return coupled to the steering of the vehicle. The actuator mechanism responds to each cycle of change in direction of the drive motor, backward and then forward, to advance the cam through discrete positions thereby controlling the steering and driving force of the vehicle with one control signal.

17 Claims, 5 Drawing Figures

SINGLE CHANNEL RADIO CONTROL SYSTEM

BACKGROUND OF THE INVENTION

Single channel continuous wave radio control systems can only control one function. One approach used in the past to expand the number of functions controlled is to utilize some sort of modulation of the carrier wave by the transmitter with a decoding of the modulated signal by the receiver to actuate the different functions. This method requires more sophistocated electronics in the transmitter, receiver and control devices with an increase in cost and maintenance of the system. The simplest control signal is the transmission of a continuous wave to indicate that the controlled item is to be in one state and when the continuous wave is no longer transmitted the controlled item reverts to another state.

Methods have been developed to expand this on/off signal to be able to control more than one function. These methods have used an escapement or a cascade of escapements to perform control of several functions. These escapements have typically utilized relays as the actuating mechanism. The use of relays increased the weight and the power drain of the control system.

Other escapements have consisted of a motor to drive the control plates. This motor is in addition to the vehicle drive motor and is best controlled by following pulse-rate and pulse length changes detected by the receiver which adds to the weight, cost and power drain of the control mechanism.

SUMMARY OF THE INVENTION

This invention relates in general to the single channel continuous wave (cw) radio control systems but has a distinct advantage in that it does not utilize a relay escapement or additional motorized sequencing servo to achieve control of more than one function.

This invention receives the cw signal and changes the direction of the vehicle drive motor as long as the cw signal is present. As soon as the cw signal stops, the original direction of the vehicle drive motor is resumed.

This invention then utilizes the change in direction of the vehicle drive motor to generate the control force that advances the steering cam. The speed of the reaction to the change in direction and the inertia of the vehicle combine to allow the advancement of the steering cam without significant loss in momentum of the vehicle.

This method of utilizing the vehicle drive motor to power the actuation of the cam allows the control of forward and reverse in the three directions of left, right, and straight to be controlled by a simple, single channel cw radio control device without the addition of an actuator that requires additional power and weighs more than the invention mechanism.

DESCRIPTION OF THE PREFERRED EMBODIMENTS

Figure 1:
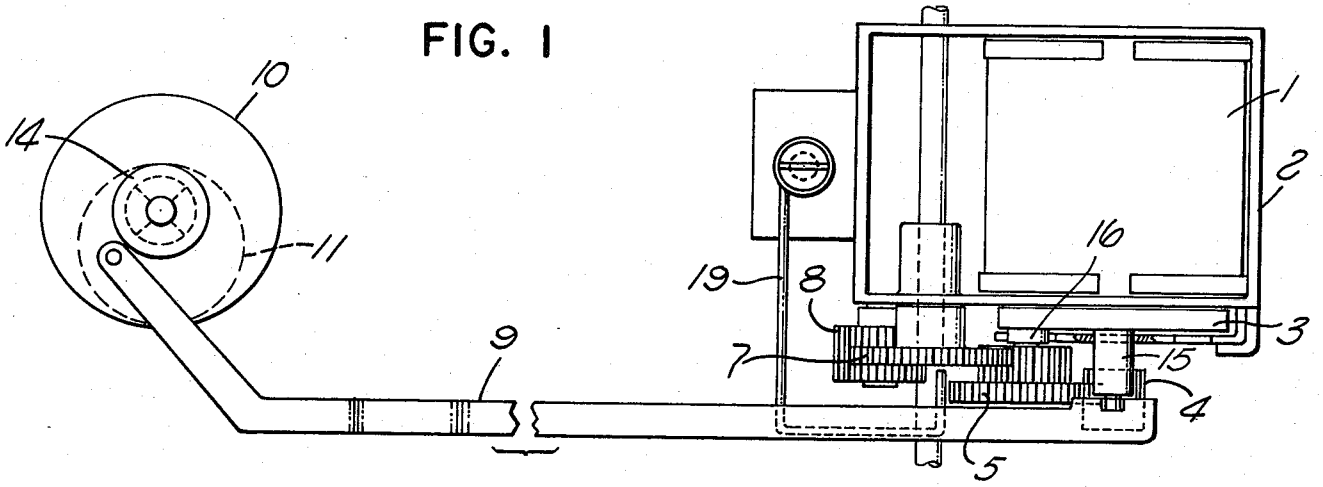
FIG. 1 is a horizontal view of the invention depicting the motor, actuator mechanism and cam.
Figure 2:
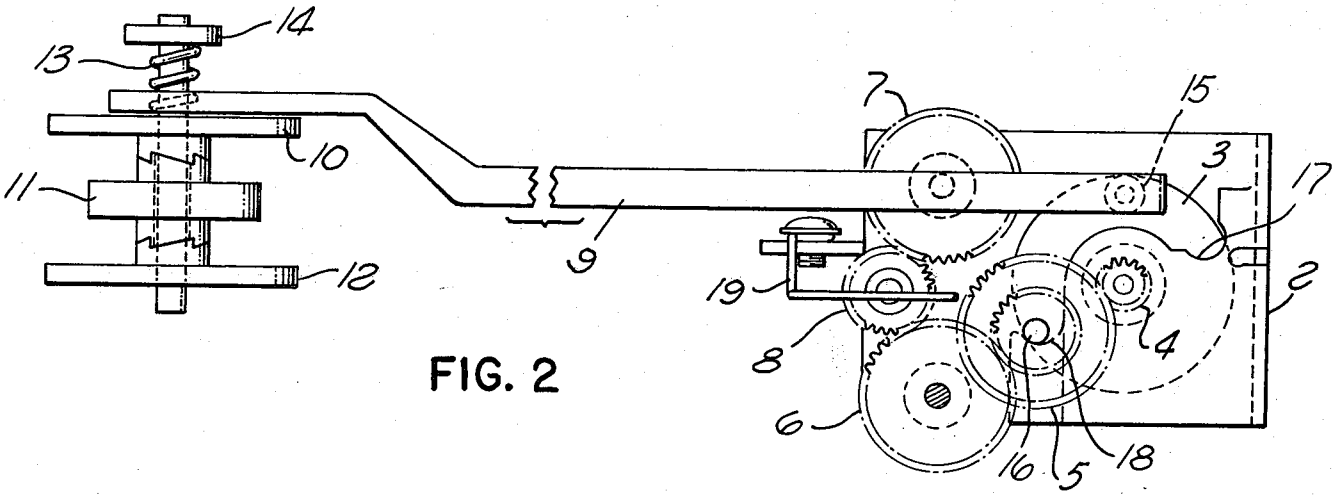
FIG. 2 is a vertical view of the invention depicting the actuator mechanism and cam.

FIG. 1 and FIG. 2 illustrate all of the essential elements of the actuator of the present invention.

A motor 1 is fixed to a motor mount 2. The power gear 4 is attached to the shaft of the rotor of the motor 1. A movable ring 3 is held in place, coaxially with the shaft of the rotor of the motor 1 by the motor mount 2 and has limited rotary motion. The ring 3 has two knobs 15 and 16 attached near the perimeter of the ring 3. A set of two planetary gears 5 are coaxially and rotarilly mounted on a knob 16 for uniform movement so that the larger gear meshes with the power gear 4. The smaller gear is attached to the larger gear to form the set of planetary gears 5. When the power gear 4 rotates counterclockwise it exerts a force on the set of planetary gears 5 such that the set of planetary gears 5 and ring 3 rotate counterclockwise until the knob 16 engages a stop 18 that is a part of the mount 2.

The location of the stop 18 is chosen so that the set of planetary gears 5 is held in a position wherein the smaller of the planetary gears 5 can engage the primary drive gear 6. The primary drive gear 6 is fixed to the shaft of the vehicle drive means such as the axle of one or both of a pair of drive wheels, or, for example, the drive shaft of a boat.

When the power gear 4 rotates clockwise, it exerts a force on the set of planetary gears 5 such that the set of planetary gears 5 and the ring 3 rotate clockwise until the knob 15 engages a stop 17 that is part of the mount 2.

The stop 17 is located such that the smaller gear of the set of planetary gears 5 will mesh with the secondary drive gear 7. The secondary drive gear 7 is mounted such that it engages an intermediate gear 8 which engages the primary drive gear 6. The stops 17 and 18 together with the knobs 15 and 16 comprise a motion limiting means for limiting the motion of the ring 3.

Thus, through the action of reversing the direction of the motor 1 the direction of the final drive gear 6 is reversed.

A simple wire spring 19 is attached to the mount 2 and positioned between the primary drive gear 6 and secondary drive gear 7 such that the largest of the set of planetary gears 5 will engage the wire spring 19 as a step from one drive gear to the other.

The movement of knob 15 with the ring 3 is utilized as the activator force to control the steering means of the vehicle through the following described mechanism.

One end of connector 9 is attached to knob 15. The other end of connector 9 is attached to plate 10. Plate 10 is free to rotate around shaft 14. The bottom of plate 10 is equipped with a set of teeth so as to engage and rotate the cam 11 while the plate is rotated counterclockwise but will slip over the cam 11 while the plate is rotated clockwise. Plate 12 is fixed to the body of the vehicle and does not rotate. When the plate 10 is rotating clockwise and slipping over cam 11, the teeth of the plate 12 engage the cam 11 and prevent the cam 11 from rotating in a clockwise manner.

The movement of knob 15 and placement of the attachment of connector 9 to plate 10 are selected to provide 90° of rotation of plate 10 each time the direction of the motor 1 is changed.

The spring 13 allows vertical movement of the cam 11 and plate 10 as each in turn slips over the teeth of plate 12 and cam 11 respectively.

Figure 3:
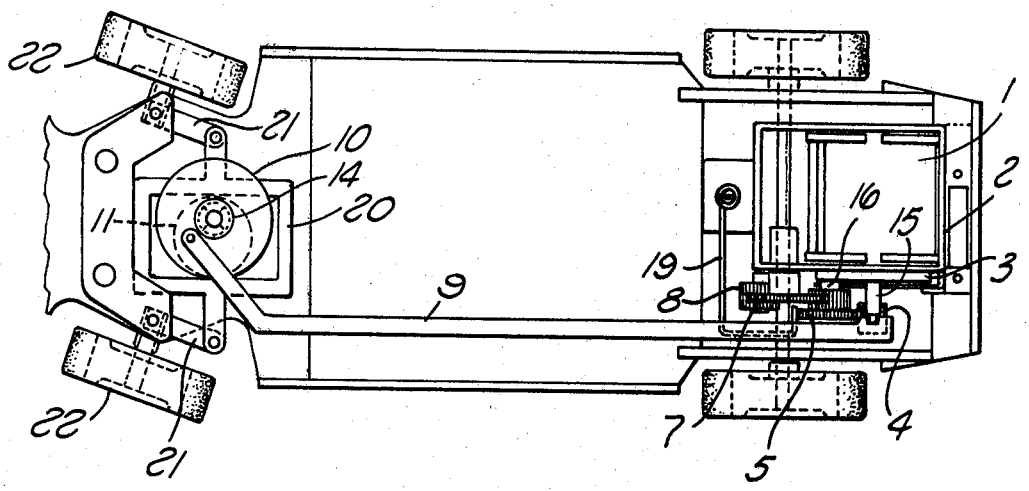
FIG. 3 is a horizontal view of the invention as applied to a toy automobile.

FIG. 3 illustrates the use of the actuator in a toy motor vehicle. The cam 11 is mounted so that it engages a box 20 that is connected to the steering wheels 22 of the vehicle by means of connecting rods 21. As the cam 11 rotates in 90° increments it moves the box 20 to the right, then center, then left and then back to center thereby controling the steering wheels 22.

Figure 4:
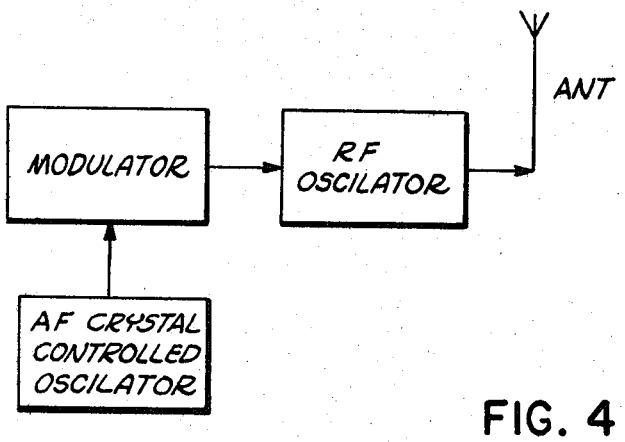
FIG. 4 is a block diagram of a typical continuous wave transmitter.

The block diagram of a single channel continuous wave transmitter of the type well known for radio control is shown in FIG. 4. It is crystal controlled to meet FCC regulations and set to transmit on a selected channel in the 27 or 72 Mhz radio control band.

Figure 5:
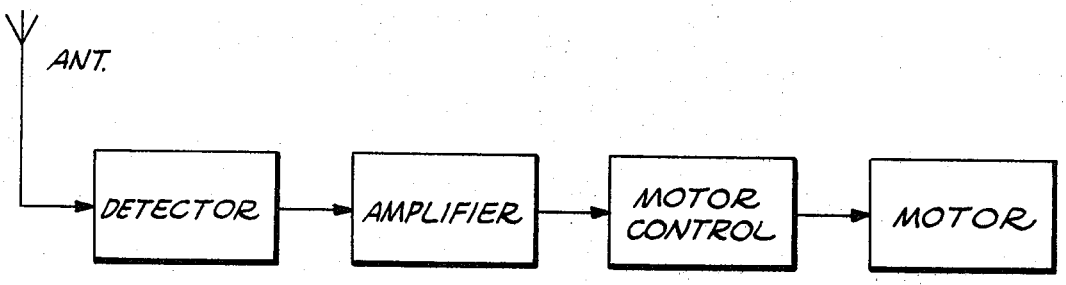
FIG. 5 is a block diagram of a typical continuous wave receiver and motor control.

A block diagram of a single channel continuous wave receiver of the type well known for radio control is shown in FIG. 5. The motor control responds to the detection by the receiver of the transmitted signal and reverses the direction of the motor. If the motor is a direct current motor, the motor control simply reverses the polarity of the current applied to the motor in response to the detected signal and changes the polarity back when the signal is no longer detected.

Since certain changes may be made in the above apparatus without departing from the scope of the invention herein involved, it is intended that all matter contained in the above description as shown in the accompanying drawings shall be interpreted in an illustrative and not in a limiting sense.

What is claimed is:

1. A system for remotely controlling the direction and motion of a vehicle which has a means to steer the vehicle, a motor, and a drive means comprising:

(A) means to transmit a single channel continuous wave control signal;

(B) means to receive the control signal;

(C) means to couple the motor to the drive means wherein the coupling means includes a primary drive gear attached to the drive means, a secondary drive gear rotably mounted on the vehicle, an intermediate gear rotably mounted on the vehicle such that the secondary drive gear is in direct drive with the primary drive gear by means of the intermediate gear, a power gear attached to the rotor of the motor, a ring mounted so that it rotates around the axis of the motor rotor, a planetary gear member mounted on the ring and being meshed with the power gear whereby the motion of the motor rotor in one direction causes the ring and the planetary gear member to rotate until the planetary gear member becomes meshed with the primary drive gear and the motion of the motor rotor in the other direction causes the ring and planetary gear member to rotate until the planetary gear member becomes meshed with the secondary drive gear;

(D) means to change the direction of the motor in response to the control signal;

(E) means to control the means to steer the vehicle in response to the same control signal.

2. The system defined in claim 1 wherein the vehicle is a four wheel vehicle and the drive means comprises one of the four wheels.

3. The system defined in claim 1 wherein the planetary gear member comprises a pair of gears coupled together for unitary rotation.

4. The system defined in claim 3 wherein a first gear of the pair of gears has a larger diameter than the second gear of the pair of gears.

5. The system defined in claim 4 wherein the second gear the pair of gears is selectively engagable with the primary drive gear and the secondary drive gear.

6. The system defined in claim 5 wherein the first gear of the pair of gears engages the power gear.

7. The system defined in claim 6 and further comprising motion limiting means for limiting the rotation of the ring.

8. The system defined in claim 7 wherein the motion limiting means further comprises a pair of knobs mounted on the ring in spaced apart relationship and a pair of stops for selectively engaging the knobs.

9. The system defined in claim 8 wherein the planetary gear is rotatably mounted on a first of said pair of knobs.

10. The system defined in claim 9 wherein the vehicle is a four wheel vehicle and a first of said wheels comprises the drive means.

11. A system for remotely controling the direction and motion of a vehicle which has a means to steer the vehicle, a motor and a drive means comprising:

(A) means to transmit a single channel continuous wave control signal;

(B) means to receive the control signal;

(C) means to couple the motor to the drive means;

(D) means to change the direction of the motor in response to the control signal;

(E) means to control the means to steer the vehicle in response to the same control signal that changes the direction of the motor includes a power gear attached to the rotor of the motor, a ring mounted so that it rotates around the axis of the motor rotor, a planetary gear member mounted on the ring and being meshed with the power gear whereby the motion of the motor rotor in one direction causes the ring and planetary gear member to rotate in one direction and the motion of the motor rotor in the other direction causes the ring and planetary gear member to rotate in the other direction, a cam coupled with the means to steer the vehicle whereby the rotation of the cam causes the means to steer to change attitude, means for coupling the cam to the ring whereby the cam is advanced each time the ring is caused to rotate in one direction but not advanced when the ring is caused to rotate in the outer direction.

12. The system defined in claim 11 wherein the motor is a DC motor and the means to change direction of the motor further comprises means for reversing the polarity of the current applied to the motor.

13. The system defined in claim 12 and further comprising motion limiting means for limiting the rotation of the ring.

14. The system defined in claim 13 wherein the motion limiting means further comprises a pair of knobs mounted on the ring in spaced apart relationship and a pair of stops for selectively engaging the knobs.

15. The system defined in claim 14 wherein the planetary gear is rotably mounted on a first of said pair of knobs.

16. The system defined in claim 15 wherein the vehicle is a four wheel vehicle and a first of said wheels comprises the drive means.

17. The system defined in claim 16 wherein a second and third of said four wheels comprises the means to steer the vehicle.

* * * * *